US009739426B2

(12) United States Patent
Hoechtl

(10) Patent No.: US 9,739,426 B2
(45) Date of Patent: Aug. 22, 2017

(54) BULB FOR SEMICONDUCTOR LUMINOUS DEVICE, AND SEMICONDUCTOR LUMINOUS DEVICE

(75) Inventor: Johannes Hoechtl, Eichstaett (DE)

(73) Assignee: Ledvance GmbH, Garching (DE)

( * ) Notice: Subject to any disclaimer, the term of this patent is extended or adjusted under 35 U.S.C. 154(b) by 0 days.

(21) Appl. No.: 14/110,928

(22) PCT Filed: Mar. 13, 2012

(86) PCT No.: PCT/EP2012/054341
§ 371 (c)(1),
(2), (4) Date: Oct. 10, 2013

(87) PCT Pub. No.: WO2012/139841
PCT Pub. Date: Oct. 18, 2012

(65) Prior Publication Data

US 2014/0029266 A1 Jan. 30, 2014

(30) Foreign Application Priority Data

Apr. 12, 2011 (DE) ..... 10 2011 007 214

(51) Int. Cl.
*F21K 99/00* (2016.01)
*F21V 13/04* (2006.01)
(Continued)

(52) U.S. Cl.
CPC ..... *F21K 9/10* (2013.01); *F21K 9/20* (2016.08); *F21K 9/235* (2016.08); *F21K 9/61* (2016.08);
(Continued)

(58) Field of Classification Search
CPC .... G02B 27/095; G02B 3/08; G02B 19/0071; G02B 6/02171; F21K 9/135; F21K 9/52;
(Continued)

(56) References Cited

U.S. PATENT DOCUMENTS 6,099,148 A 8/2000 Northrup et al.
6,483,439 B1 * 11/2002 Vukosic ..... 340/815.65
(Continued)

FOREIGN PATENT DOCUMENTS

CN 2578670 Y 10/2003
CN 1640199 A 7/2005
(Continued)

OTHER PUBLICATIONS

English abstract of DE 202004009566 U1 dated Aug. 26, 2004.
(Continued)

*Primary Examiner* — Anh Mai
*Assistant Examiner* — Arman B Fallahkhair
(74) *Attorney, Agent, or Firm* — Hayes Soloway PC

(57) ABSTRACT

A bulb for a semiconductor luminous device is provided. The bulb is three-dimensionally extended and includes at least one optically effective surface structure. A semiconductor luminous device may include at least one semiconductor light source and an optically transmissive bulb for transmitting light emitted by the at least one semiconductor light source, the bulb being three-dimensionally extended and comprising at least one optically effective surface structure, wherein the bulb encloses at least one semiconductor light source.

10 Claims, 8 Drawing Sheets

(51) Int. Cl.

| | |
|---|---|
| ***F21V 3/00*** | (2015.01) |
| ***F21K 9/20*** | (2016.01) |
| ***F21K 9/61*** | (2016.01) |
| ***F21K 9/235*** | (2016.01) |
| *F21Y 115/10* | (2016.01) |

(52) U.S. Cl.
CPC ..... *F21V 3/00* (2013.01); *F21V 13/04* (2013.01); *F21Y 2115/10* (2016.08)

(58) Field of Classification Search
CPC . F21K 9/00; F21K 9/50; F21K 9/1355; F21K 9/10; F21V 3/00; F21V 13/04
USPC ..... 362/186, 291, 296.05, 235, 311.02, 362/294.02, 329, 310, 308, 335, 311.01, 362/311.14
See application file for complete search history.

(56) References Cited

U.S. PATENT DOCUMENTS

| | | | | |
|---|---|---|---|---|
| 6,659,632 | B2 * | 12/2003 | Chen | H05K 1/189 362/249.06 |
| 6,679,621 | B2 * | 1/2004 | West | F21V 5/04 257/E33.059 |
| 6,991,351 | B1 | 1/2006 | Petrick | |
| 7,006,306 | B2 * | 2/2006 | Falicoff et al. | 359/800 |
| 7,736,020 | B2 * | 6/2010 | Baroky et al. | 362/249.02 |
| 8,075,147 | B2 * | 12/2011 | Chaves et al. | 362/84 |
| 8,138,672 | B2 * | 3/2012 | Lai et al. | 313/512 |
| 8,330,342 | B2 * | 12/2012 | Bhairi | 313/116 |
| 8,360,604 | B2 * | 1/2013 | Negley et al. | 362/235 |
| 2005/0105302 | A1 | 5/2005 | Hofmann et al. | |
| 2006/0034077 | A1 | 2/2006 | Chang | |
| 2007/0091598 | A1 * | 4/2007 | Chen | F21V 29/00 362/231 |
| 2007/0291482 | A1 | 12/2007 | Baroky et al. | |
| 2008/0068837 | A1 | 3/2008 | Chiu et al. | |
| 2010/0060130 | A1 | 3/2010 | Li | |
| 2011/0031871 | A1 | 2/2011 | Lai et al. | |
| 2011/0075408 | A1 | 3/2011 | Negley et al. | |
| 2011/0156584 | A1 | 6/2011 | Kim | |
| 2011/0286200 | A1 * | 11/2011 | Iimura | F21K 9/135 362/84 |
| 2012/0273663 | A1 | 11/2012 | Young | |

FOREIGN PATENT DOCUMENTS

| | | | |
|---|---|---|---|
| CN | 101988646 | A | 3/2011 |
| DE | 202004009566 | U1 | 8/2004 |
| DE | 202009006868 | U1 | 8/2009 |
| EP | 2282109 | A2 | 2/2011 |
| JP | 2002245819 | A | 8/2002 |
| KR | 100883344 | B1 | 2/2009 |
| WO | 03059012 | A1 | 7/2003 |
| WO | 2005050710 | A2 | 6/2005 |
| WO | 2010055339 | A2 | 5/2010 |
| WO | 2011029158 | A1 | 3/2011 |

OTHER PUBLICATIONS

English abstract of JP 2002245819 A dated Aug. 30, 2002.
Chinese Office Action based on Application No. 201280017997.0(7 Pages and 6 pages of English translation) dated Aug. 11, 2015 (Reference Purpose Only).
Chinese Office Action based on Application No. 201280017997.0(8 Pages and 6 pages of English translation) dated Mar. 15, 2016 (Reference Purpose Only).
German Office Action based on Application No. 10 2011 007 214.4(5 Pages) dated Mar. 8, 2012 (Reference Purpose Only).

* cited by examiner

BULB FOR SEMICONDUCTOR LUMINOUS DEVICE, AND SEMICONDUCTOR LUMINOUS DEVICE

RELATED APPLICATIONS

This application is a national stage entry according to 35 U.S.C. §371 of PCT application No.: PCT/EP2012/054341 filed on Mar. 13, 2012, which claims priority from German application No.: 10 2011 007 214.4 filed on Apr. 12, 2011.

TECHNICAL FIELD

Various embodiments relate to a three-dimensionally extended bulb for a semiconductor luminous device. Various embodiments furthermore relate to a semiconductor luminous device having such a bulb.

BACKGROUND

LED incandescent lamp retrofit lamps which include light-emitting diodes (LEDs) as light sources, and which are intended to replace conventional incandescent lamps, are known. To this end, the incandescent lamp retrofit lamps should not substantially exceed an external dimension of the conventional incandescent lamp. At the same time, an incandescent lamp retrofit lamp should also be able to replicate the essentially omnidirectional light distribution of the conventional incandescent lamp. This, however, is not readily possible owing to the directional light emission characteristic of light-emitting diodes. During operation, it is furthermore necessary to ensure sufficient cooling of the light-emitting diodes, to which end a heat sink is used. However, the heat sink obscures a part of the surrounding space, so that omnidirectional light emission is made more difficult. The light-emitting diodes are typically arched over by an optically transmissive bulb.

One possibility for at least approximating omnidirectional light emission consists in using an incandescent lamp retrofit lamp having a plurality of light-emitting diodes, which are oriented in different directions. The superimposed light distributions of the light-emitting diodes give the overall emission pattern of the incandescent lamp retrofit lamp. This, however, entails an either relatively large-area or relatively complicated (and therefore elaborate to install) arrangement of the light-emitting diodes.

Another possibility for approximating omnidirectional light emission consists in coating the bulb with a luminescent material ("remote phosphor"), the luminescent material partly wavelength-converting light incident thereon from an LED, and partly re-emitting it diffusely without wavelength conversion. However, such a lamp is elaborate and furthermore cost-intensive in its design.

Another possibility for approximating omnidirectional light emission consists in using reflectors. However, these cause shadowing and an efficiency loss.

SUMMARY

Various embodiments at least partially overcome the disadvantages of the prior art and, in particular, provide a simply and economically producible luminous device having sufficiently omnidirectional light emission, particularly in the case of an incandescent lamp retrofit lamp.

The object is achieved by an (at least partially) optically transmissive bulb for a semiconductor luminous device, wherein the bulb is three-dimensionally extended and includes at least one optically effective surface structure.

The three-dimensional extent permits (in contrast to an essentially only planar, "two-dimensional" cover plate) permits improved wide-angle emission of light, i.e. in particular in angle ranges which cannot or can only to a small extent be illuminated without the optical effect of the bulb, for example including angle ranges, which are larger than a half-space. The three-dimensional extent includes, for example, a curved shape of the bulb or a high-standing, forwardly open shape of the bulb.

Owing to the surface structure, light emerging from the bulb can be directed in a controlled way into predetermined spatial regions, and in particular deviated in a controlled way, in particular for improved large-space (in particular omnidirectional) emission. In particular, light can in this way be emitted more strongly laterally and (in relation to a longitudinal direction of the luminous device) backward. This especially permits large-area light emission for the case in which light strikes the bulb with a significantly irregular spatial distribution. By means of the surface structure, a complicated orientation, in particular oriented in different directions, of a plurality of light-emitting diodes can at least partially be obviated. Furthermore, the bulb does not need to be coated elaborately with luminescent material. Furthermore, for example, provision of additional dedicated reflector bodies or light-guide bodies can be obviated.

A semiconductor luminous device is intended, in particular, to mean a luminous device which includes at least one semiconductor light source, in particular only at least one semiconductor light source, in particular light-emitting diode(s).

Preferably, the at least one semiconductor light source includes at least one light-emitting diode. When there are a plurality of light-emitting diodes, these may illuminate in the same color or in different colors. A color may be monochromatic (for example red, green, blue, etc.) or polychromatic (for example white). The light emitted by the at least one light-emitting diode may also be infrared light (IR-LED) or ultraviolet light (UV-LED). A plurality of light-emitting diodes may generate mixed light; for example, white mixed light. The at least one light-emitting diode may contain at least one light wavelength-converting luminous material (conversion LED). The at least one light-emitting diode may be in the form of at least one individually packaged light-emitting diode or in the form of at least one LED chip. A plurality of LED chips may be mounted on a common substrate ("submount"). The at least one light-emitting diode may be equipped with at least one optical unit of its own and/or a common optical unit for beam guiding, for example at least one Fresnel lens, collimator, etc. Instead of or in addition to inorganic light-emitting diodes, for example based on InGaN or AlInGaP, organic LEDs (OLEDs, for example polymer OLEDs) are generally also usable. As an alternative, the at least one semiconductor light source may for example include at least one diode laser.

The luminous device may generally include one or more optically active surface structures. An optically active surface structure may in particular be a surface structure which, owing to its shape, significantly deviates a light ray incident on it, in particular significantly more strongly than an unstructured (planar) surface.

The at least one optically active surface structure may be present on an inner side of the bulb and/or, preferably, on an outer side of the bulb.

It is a refinement that the bulb includes annular elevations (as the at least one optically active surface structure) extending at least sector-wise in a circumferential direction. Owing to these elevations, significant orientation of the light emitted by the surface structure can be achieved. The annular elevations are preferably triangular in profile, although in general they are not restricted to a triangular shape. A plurality of annular elevations may have the same or different thicknesses and/or triangular shapes. However, the profile shape of the elevations is not restricted, and may for example be configured to be freeform, polygonal, curved, etc. at least in sections.

It is a particular refinement that the annular elevations are configured in the form of Fresnel rings. This permits a lens-like effect of the surface structure.

It is another refinement that the optically active surface structure includes at least one convexly shaped projection and/or at least one concavely shaped indentation, since, in particular, this makes lens-like imaging possible. Also, for example, an optically active surface structure in the form of a cushion structure is possible.

It is furthermore a configuration that the bulb includes a base region having a hollow-cylindrical base shape, the annular elevations being arranged on an external lateral surface of the base region. In this way, in particular, direction of light to the side and backward (opposite to the longitudinal direction of the bulb) can be reinforced.

It is another configuration that the bulb is open on two sides, or both end surfaces of the bulb are open. In this way, light can be emitted partially from one of the open end surfaces without having to pass through the bulb. This also permits a particularly simple air supply to the light sources and consequently particularly effective cooling. In other words, after it is mounted on a luminous device, the bulb is an upwardly open bulb.

It is an alternative configuration that the base region is covered on one side by means of a cover region having a base shape in the form of a spherical cap, or an end surface of the base region is covered by means of a cover region having a base shape in the form of a spherical cap. The cover region makes it possible to protect the semiconductor light source(s) arched over by the bulb. The cover region may itself be optically inactive and, for example, have a simple dish shape. It is another alternative configuration that the base region is covered on one side by means of a cover region having a base shape in the form of a funnel, or an end surface of the base region is covered by means of a cover region having a base shape in the form of a funnel. The basic shape in the form of a funnel permits a homogenized transition of the light distribution from a forwardly directed region to a lateral region.

It is furthermore a configuration that the bulb has a base shape in the form of a spherical cap. This permits particularly close shape adaptation to a conventional incandescent lamp.

It is also a further configuration that the bulb includes at least one through-bore. The at least one through-bore may be used as an optically active surface structure. At least one through-bore may also be used for air exchange and therefore improved cooling of the light sources. At least one through-bore may be used for fastening the bulb, for example as a screw hole. At least one through-bore may fulfill several of these functions.

It is also another configuration that an optical element is fastened on at least one through-bore. This permits particularly flexible configuration of the bulb, in particular for different applications. In particular, depending on the configuration, differently shaped optical elements may in this way be applied to the same base shape. Furthermore, a complex shape of the surface structure is combined with comparatively simple production, and therefore also a particularly good approximation to wide-angle light emission. The optical element may, in particular, extend laterally beyond the rest of the bulb in order to permit effective light emission backward (into a lower half-space). An optical element may in particular, together with the through-bore, constitute an optically active surface structure.

The optical element may, in particular, be plugged into an associated through-bore. The optical element may be fastened on the through-bore in particular by means of a press-fit, by means of an engagement connection, for example snap-fit connection, and/or by means of an adhesive bond, in particular glue bond.

It is a refinement that the at least one through-bore includes a plurality of through-bores which are arranged separated, in particular equally separated, in a circumferential direction of the bulb. This permits light emission uniformly distributed to a high degree in the circumferential direction. The through-bores may in particular lie in a common, in particular horizontal, plane.

It is also a further configuration that the bulb includes at least one recess, for receiving at least one light source, on a bearing surface. In this way, the light of at least one light source can be shone essentially directly into the bulb (and not through a space covered or enclosed by the bulb per se). This offers the advantage that the bulb can also be used as a light guide, and particularly effective light distribution is made possible. Furthermore, a space covered or enclosed by the bulb ("bulb space") becomes usable for other elements, for example for a driver, which makes a particularly compact luminous device possible.

As an alternative, the bulb may laterally enclose the at least one semiconductor light source at least partially. In particular, a base region having a hollow base shape, open on at least two sides, for example in the form of a hollow cylinder, may laterally enclose the at least one semiconductor light source.

It is a refinement that at least one carrier for electrical and/or electronic components, in particular a driver unit, extends at least partially into a space enclosed by the bulb (the bulb space), or is arranged there. This makes a particularly compact luminous device possible. The driver (unit) and/or an inner side of the bulb may in particular be configured to be at least partially reflective, in order to reduce light losses. Furthermore, this offers a thermal advantage, in particular since input of heat onto light-emitting diodes arranged further below is smaller and additional cooling of the driver is possible through an open bulb and/or bores. The reflective configuration of the inner side of the bulb furthermore makes it possible to conceal the driver from view. The bulb, in particular when the driver is present inside the bulb space, may include one or more cooling channels which connect the bulb space to an outer side. The cooling channels may also be provided by means of the through-bores.

The bulb may, in particular, be configured in one piece.

The bulb may be transparent or translucent. In particular, a translucent bulb may also lead to a light distribution which is homogenized in respect of intensity or brightness, and optionally also color. The translucent bulb may, in particular, be milky. The bulb may also include scattering particles, for example an oil-in-water suspension, or scattering particles used as fillers or gas inclusions.

There may also be at least one wavelength-converting luminous material on the bulb.

The bulb may, in particular, consist of glass or plastic.

The bulb may be reflectively coated at least partially. The bulb may be coated partially or fully on its side facing toward the bulb space. The bulb may, in addition or as an alternative, be partially coated on its outer side facing away from the bulb space.

The bulb may essentially be single-walled or multi-walled.

The object is also achieved by a semiconductor luminous device including at least one optically transmissive bulb as described above.

It is a configuration that the semiconductor luminous device includes at least one semiconductor light source, the optically transparent bulb being used to transmit light emitted by the at least one semiconductor light source, and the bulb enclosing at least one semiconductor light source, i.e. enclosing it in particular laterally or enclosing or covering it laterally and from above.

It is another configuration that the at least one semiconductor light source is oriented forward. This is intended, in particular, to mean orientation of the light source per se (but not necessarily of the associated main emission direction) in a direction along a longitudinal axis of the luminous device. Particularly when there are a plurality of light sources directed forward, the application thereof is significantly simplified in this way. In particular, the semiconductor light sources may be arranged on a horizontal placement region.

A longitudinal axis of the luminous device may, in particular, extend from a lowermost point of a cap to an uppermost point, in which case the uppermost point may in particular be formed by a tip of the bulb. The longitudinal axis may correspond at least essentially to a symmetry axis of the luminous device and/or of the bulb.

It is furthermore a configuration that a main emission direction (which includes an intensity maximum of the emitted light) of the at least one semiconductor light source is directed to the side (not parallel to the longitudinal axis of the luminous device or of the bulb). In this way, a particularly high proportion of the light can be emitted laterally and/or backward. The semiconductor light sources may in particular have (a) main emission direction(s) lying in the same, in particular horizontal, plane. To this end, the semiconductor light sources may have a main emission direction which at least essentially coincides with an optical symmetry axis ("semiconductor light sources emitting in the forward direction") and then be oriented or mounted in an inclined way. As an alternative, the semiconductor light sources may be oriented or mounted forward, but have a main emission direction which does not coincide with the optical symmetry axis ("semiconductor light sources emitting laterally").

It is preferred for the semiconductor light sources to be arranged rotationally symmetrically, which reinforces a light distribution which is uniform in the circumferential direction as well as simplified component application.

It is particularly preferred for the associated bulb to include at least one through-bore which is associated with a semiconductor light source and has an optical element fastened on it. In particular, each of the semiconductor light sources may be assigned an optical element which lies in the region of the main emission direction of the associated semiconductor light source. In particular, a longitudinal axis of the through-bore may coincide with a main emission direction of the semiconductor light source, i.e. the semiconductor light source is directed into the through-bore.

The luminous device is in principle not restricted and may include luminous systems, lights and modules. Owing to the particularly simply producible and compact structure of the bulb, use of the bulb with a lamp as the luminous device is particularly preferred. The lamp may, in particular, be a retrofit lamp.

It is a particularly preferred configuration that the semiconductor luminous device is an incandescent lamp retrofit lamp. In particular, when the luminous device is designed as an incandescent lamp retrofit lamp, the bulb permits enhanced omnidirectional light emission without dedicated reflector elements, luminescent material regions, etc. However, the disclosure is not restricted thereto and may also cover other types of retrofit lamps, for example a halogen lamp retrofit lamp, a fluorescent tube retrofit lamp or a linear lamp retrofit lamp.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
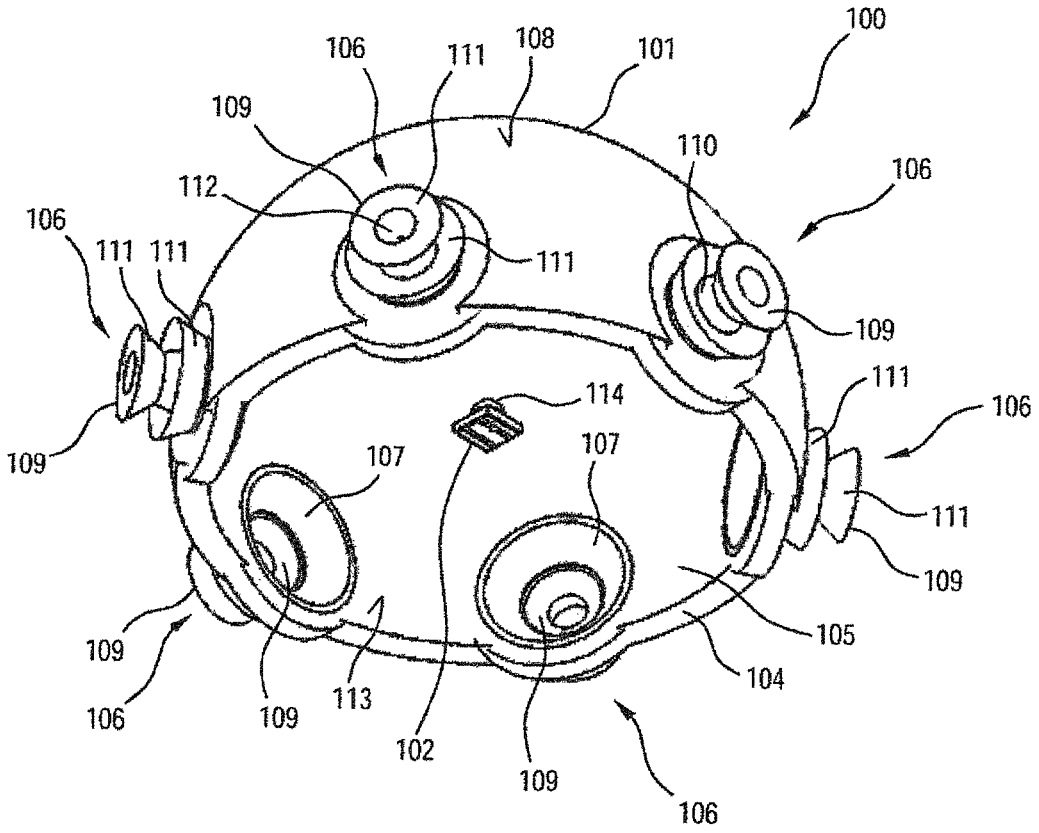
FIG. 1 shows a bulb according to a first embodiment, together with a luminous unit, in a view obliquely from below.
Figure 2:
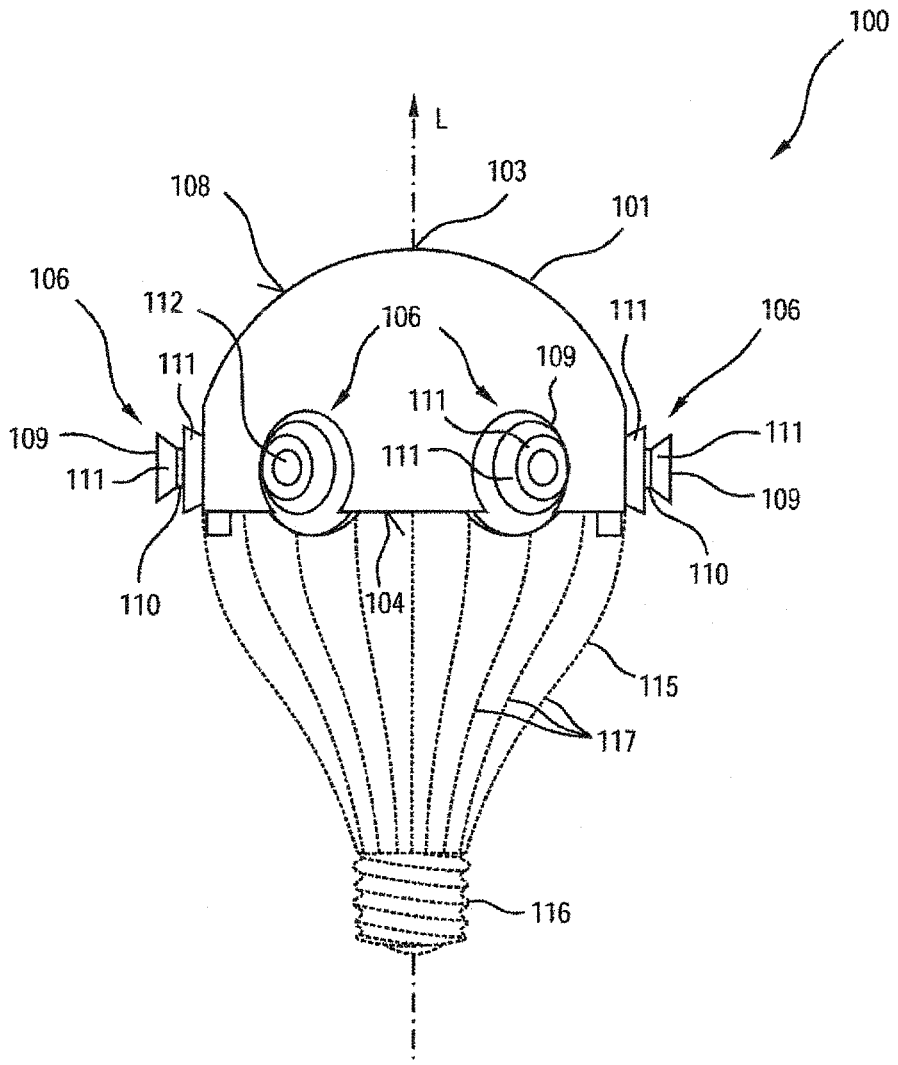
FIG. 2 shows a luminous device including the bulb according to the first embodiment in a side view.
Figure 3:
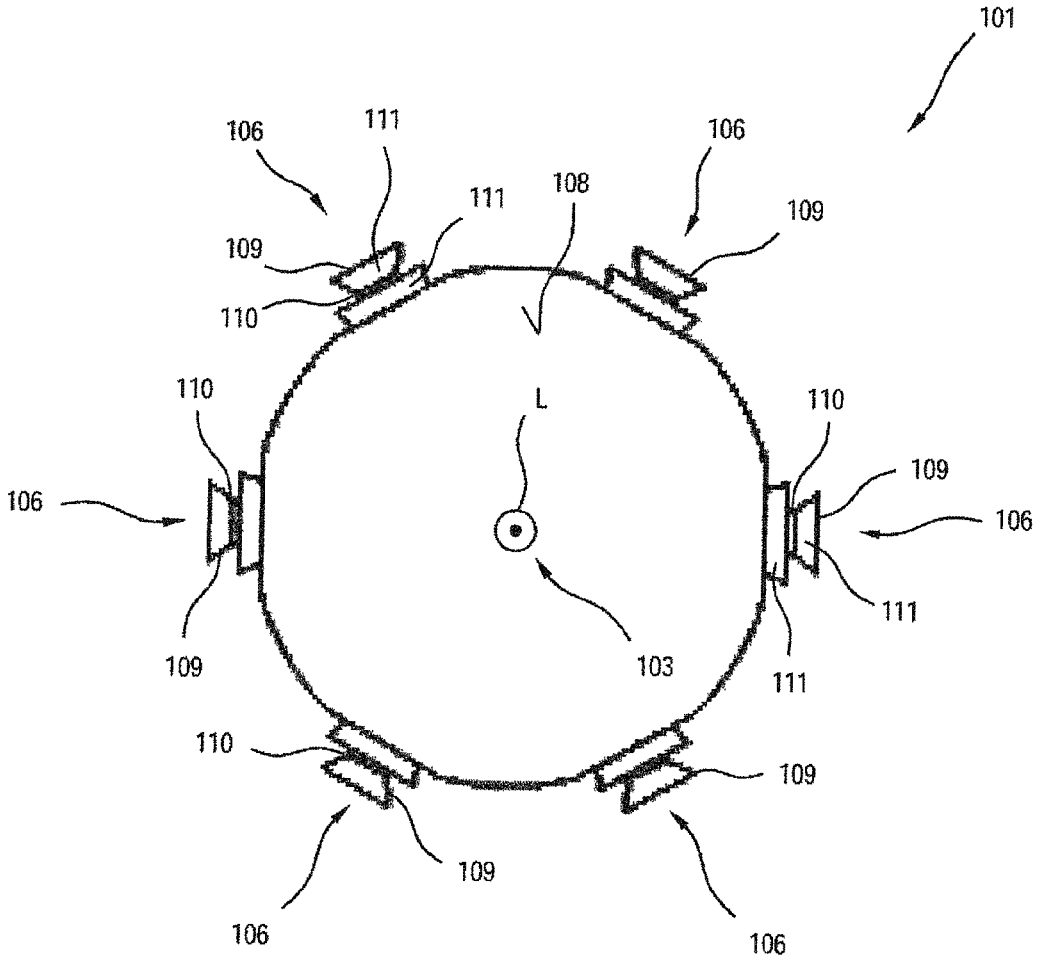
FIG. 3 shows the bulb according to the first embodiment in a plan view.

FIG. 1 shows elements of a luminous device 100 in a view obliquely from below, namely a bulb 101 according to a first embodiment together with a luminous unit 102. FIG. 2 shows the luminous device 100 with the bulb 101 in a side view. FIG. 3 shows the bulb 101 in a plan view.

The bulb 101 has a base shape in the form of a spherical cap, in particular an at least approximately hemispherical base shape, and is consequently three-dimensionally extended. The bulb 101 has a (front) tip 103 and a (backward or rear) bearing edge 104. The bulb 101 may be fitted in particular onto a heat sink (not shown) of the luminous device 100 by means of the bearing edge 104. The bulb 101 has a longitudinal axis L, which extends from the middle of a plane bounded by the bearing edge 104 to the tip 103. The longitudinal axis L at the same time constitutes a symmetry axis for the bulb 101. The bulb 101 delimits and arches over a bulb space 105. The bulb 101 is suitable in particular for a luminous device 100 in the form of an incandescent lamp retrofit lamp, since it is configured with a shape particularly compatible therewith.

FIG. 2 shows that the longitudinal axis L also constitutes a longitudinal axis of the luminous device 100, which extends from a backward end formed by a cap 116 to the tip.

The bulb has six identically constructed optically effective surface structures 106, which are arranged in the bulb 101 on a region of a largest lateral extent, or of a largest diameter, specifically in the circumferential direction, i.e. here rotationally symmetrically by 60°, about the longitudinal axis L.

Each of the surface structures 106 has a through-bore 107 extending at least essentially perpendicularly through the bulb 101. From an outer side 108 of the bulb 101, an optical element 109 is inserted into the through-bore 107 and firmly connected thereto.

Each optical element 109 has a hollow cylindrical base shape, on the outer lateral surface 110 of which two annular elevations 111 with a respective triangular profile extend. A longitudinal hole 112 formed by an inner wall of the optical element 109 is perpendicular to the longitudinal axis L of the bulb 101. In the region of the optical element 109, the bearing edge 104 bulges downward, which permits accurate positioning of the bulb 101 in relation to its rotational position about the longitudinal axis L.

For simple production, the optical elements 109 may, in particular, have been produced separately and subsequently fastened (in particular plugged on or plugged in) on the associated through-bore 107, for example by a press-fit, clamped fit and/or adhesive bond, etc. The optical elements 109 may, as an alternative, be present integrally on the bulb 101. The luminous device 102 may include one or more light-emitting diodes 114 as semiconductor light sources. The luminous device 100, or at least one light-emitting diode 114 thereof, essentially emits laterally in this case. This may in particular mean that a main emission direction is oblique, in particular perpendicular, to the longitudinal axis L. A main emission direction may, in particular, be understood as an emission direction which includes an intensity maximum or brightness maximum of the semiconductor light source. In the case of the luminous device 100, its main emission direction (or the main emission direction of the associated light-emitting diode(s) 114) is directed at the through-bore 107 and the longitudinal hole 112, and extends through the longitudinal hole 112. The longitudinal hole 112 can therefore be used both as a light passage opening and as an air exchange opening.

The light-emitting diode(s) 114 may in this case be mounted with a forward orientation, i.e. they are mounted on a plane which is horizontal in relation to the longitudinal axis L and are oriented with their own longitudinal axis parallel to the longitudinal axis L. The light-emitting diode (s) 114 then in particular have a main emission direction which differs from their longitudinal axis ("light-emitting diode emitting laterally" 114). As an alternative, the light-emitting diode(s) 114 may be mounted with a lateral orientation, i.e. they are mounted in a plane not oriented horizontally in relation to the longitudinal axis L and are oriented with their own longitudinal axis not parallel to the longitudinal axis L. The light-emitting diode(s) 114 then in particular have a main emission direction which does not differ from their own longitudinal axis ("light-emitting diode emitting in the forward direction" 114).

Owing to the fact that the optical elements 109 extend laterally beyond the rest of the bulb 101, light from the optical elements 109 can also be emitted straightforwardly in a direction directed oppositely to the direction of the longitudinal axis L ('backward' or 'into a rear half-space'), so that a particularly large solid angle range can be illuminated. In this case, in particular, a heat sink 115 of the luminous device 100, present below the bearing edge 104, is not or is not substantially an impediment, since the optical elements 109 in particular also extend laterally beyond the heat sink 115. The heat sink may include a plurality of external cooling fins 117, and may also have a driver cavity (not shown) for receiving a driver (not shown).

For further adjustment of the light emission pattern, an inner side 113 of the bulb 101 may at least partially be configured to be specularly or diffusely reflective.

If there are no optical elements 109, the through-bores 107 may be used to an increased extent for the air feed-through. The longitudinal hole 112 may also be obviated.

Figure 4:
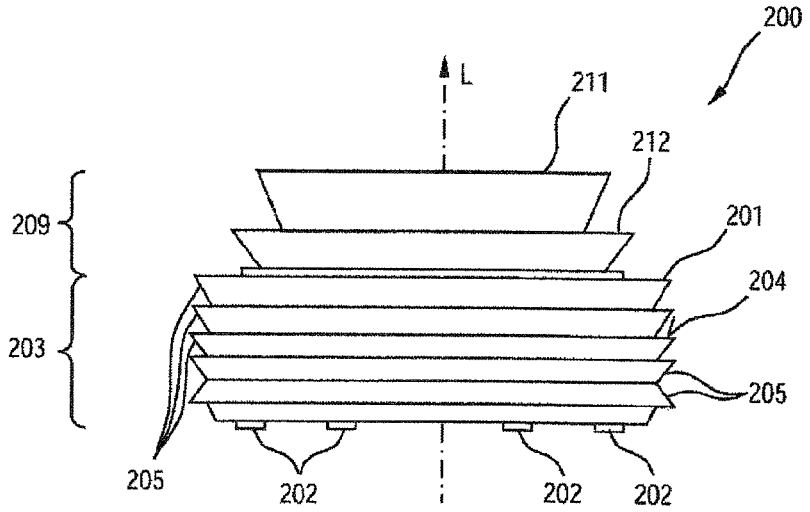
FIG. 4 shows a bulb according to a second embodiment, together with a plurality of light-emitting diodes, in side view.
Figure 5:
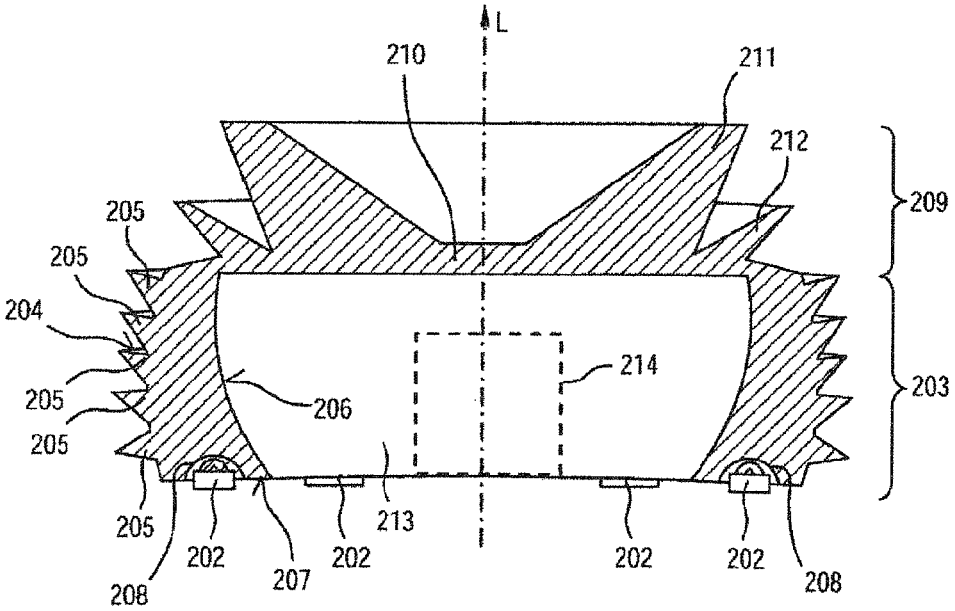
FIG. 5 shows the bulb according to the second embodiment, with the light-emitting diodes, as a sectional representation in side view.
Figure 6:
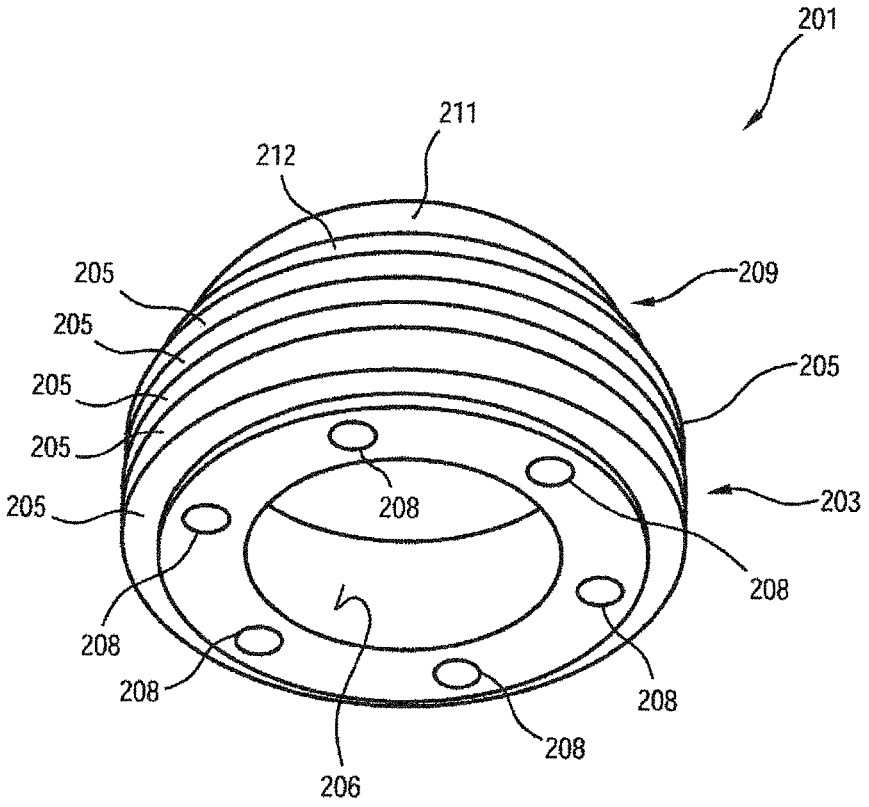
FIG. 6 shows the bulb according to the second embodiment in a view obliquely from below.

FIG. 4 shows, in a side view, a three-dimensionally extended bulb 201 according to a second embodiment together with a plurality of light-emitting diodes 202 of a luminous device 200. FIG. 5 shows the elements 201, 202 as a sectional representation in side view. FIG. 6 shows the bulb 201 in a view obliquely from below.

The bulb 201 in this case has a hollow-cylindrically shaped base region 203, the outer lateral surface 204 of which includes laterally projecting annular elevations 205 extending in the circumferential direction (about the longitudinal axis L) as an optically effective surface structure. The elevations 205 are formed in a similar way to Fresnel rings. The elevations 205 have a triangular shape in profile, the elevations 205 not necessarily having either the same sizes or the same triangular shape.

The inner side 206 is widened in profile in the direction of its bearing surface 207, in order to provide space in the bearing surface 207 for a plurality of recesses 208 or indentations for respectively receiving at least one light-emitting diode 202 (here mounted with a forward orientation). The inner side 206 has the shape of a section of a sphere.

The bulb 201 consequently encloses the light-emitting diodes 202 by arching over them by means of the bearing surface 207.

The light-emitting diodes 202 emit essentially fully through the bearing surface 207, or the recesses 208 thereof, into the bulb 201. The light-emitting diodes 202 may to this end, in particular, be mounted with a forward orientation and have a main emission direction parallel to the longitudinal axis L. The bulb 201 also acts, in particular, in this case as a light guide or light-guide element, and emits light outward in an enhanced fashion in the region of the annular elevations 205.

By adjustment of a shape and orientation of the annular elevations 205, the solid angle-related light distribution can be adjusted in a defined way. For coverage, the base region 203 is covered forward (in the direction of the longitudinal axis L) on its front end by a cover region 209.

The cover region 209 has a base shape in the form of a funnel, with a planar bottom 210. From a funnel-shaped projection 211 of the cover region 209, used as a further part of the optically effective surface structure, a further annular projection 212 extends on the outer side in order to permit transition with the base region 203 without discontinuities in the brightness which are perceptible in practice.

The inner side 206 of the bulb 201 may also in this case at least partially, including fully, be configured to be specularly or diffusely reflective.

The bulb 201 readily permits, in particular, problem-free accommodation of a driver or driver unit 214 in the bulb space 213, since the bulb space 213 is not, or is only slightly, significant for light guiding. This permits a particularly compact luminous device 200. Light losses can also be kept particularly low in this way.

Figure 7:
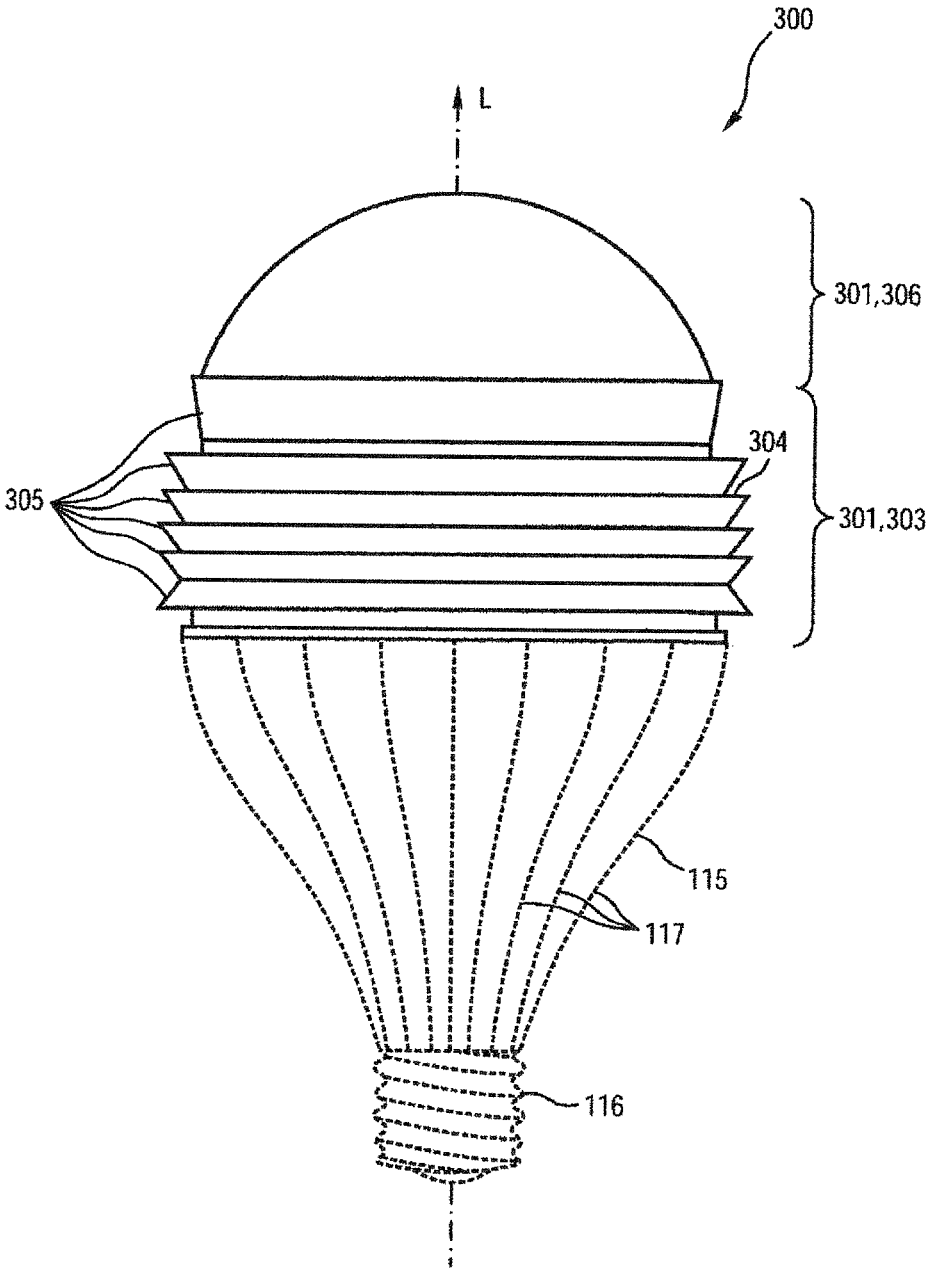
FIG. 7 shows a bulb according to a third embodiment in a side view.
Figure 8:
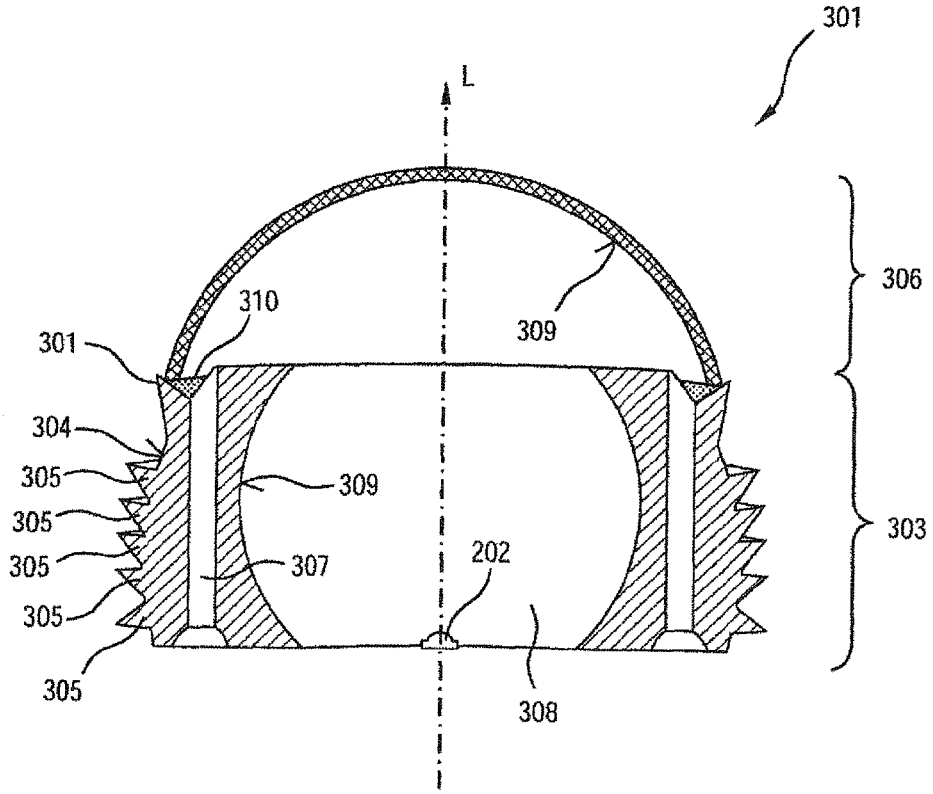
FIG. 8 shows the bulb according to the third embodiment as a sectional representation in side view.

FIG. 7 shows a luminous device 300 having a bulb 301 according to a third embodiment in a side view. FIG. 8 shows the bulb 301 as a sectional representation in side view.

The bulb 301 has a hollow-cylindrically shaped base region 303, the outer lateral surface 304 of which includes annular elevations 305 extending in the circumferential direction, similar to Fresnel rings, as an optically effective surface structure. The elevations 305 have a triangular shape in profile, the elevations 305 not necessarily having either the same sizes or the same triangular shape.

In contrast to the bulb 201, the bulb 301 has a cover region 306 in the form of a dish in the shape of a spherical cap, with an unstructured surface. Furthermore, the base region 303 has perpendicularly extending bores 307 which connect the bulb space 308 arched over by the bulb 301 to an environment of the bulb space 308, in order to permit air exchange for cooling of the light-emitting diode 202 (emitting in the forward direction). A light distribution, in particular emission into the front half space, can also straightforwardly be controlled more accurately in this way, for example by means of an, optionally different, diameter of the bore(s).

This bulb 301 essentially does not deviate light emitted forward by the light-emitting diode 202 and not passing through the base region 303, while light striking the base region 303 can be deviated at least partially to an enhanced degree laterally or even backward. If the light-emitting diode 202 is a light-emitting diode emitting in the forward direction, a higher proportion of light will shine through the dish-shaped cover region 306 than in the case of a laterally emitting light-emitting diode.

An inner side 309, formed in the shape of a section of a sphere, of the bulb 301, may here again at least partially be configured to be specularly or diffusely reflective.

The bulb 300 is in this case formed in two parts, the base region 303 and the cover region 306 having been produced separately, and the cover region 306 being fitted into a groove filled with adhesive 310 in an upper edge of the base region.

The light-emitting diodes 202 may, as an alternative, be covered by the bulb 301 in the region of the bores 307, and consequently emit into the bores 307.

Figure 9:
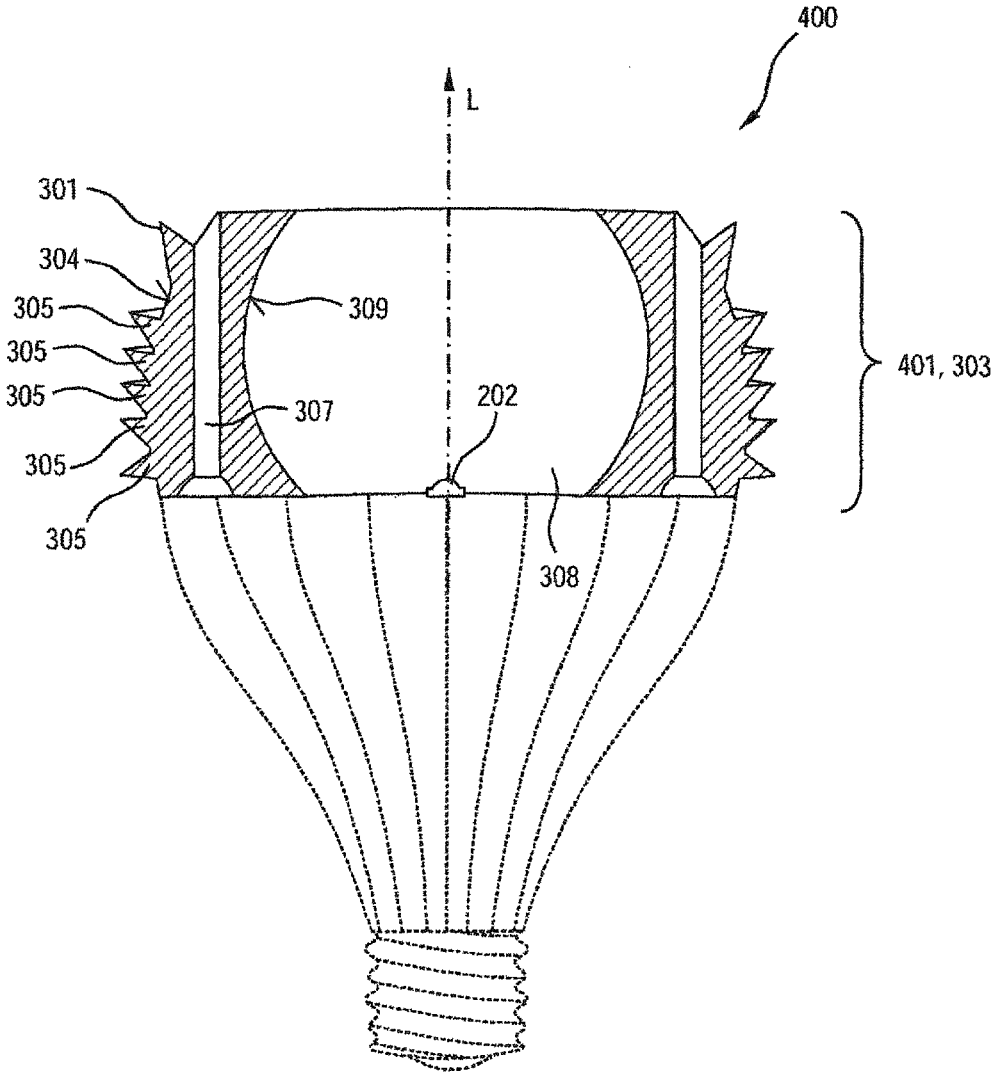
FIG. 9 shows a bulb according to a fourth embodiment, together with a light-emitting diode, in a side view.

FIG. 9 shows a luminous device 400 having a bulb 401 according to a fourth embodiment in a side view. The bulb 401 corresponds at least essentially to the base region 303 of the bulb 301, but does not have a cover region 306. The bulb 401 is thus in this case open on both sides (upper side and lower side). This permits particularly loss-free light emission in a forward direction.

Of course, the disclosure is not restricted to the exemplary embodiments presented.

In particular, features of the various exemplary embodiments may also be interchanged or combined. For example, the spherical cap-shaped cover region 306 may have one or more surface structures 106.

In general, bores for light guiding (in particular fine adjustment of the light emission pattern), air cooling and/or fastening the bulb may be introduced into a bulb. In general, in order to adjust the emission pattern, an inner wall and/or an outer wall of the bulb may be coated, for example with a luminescent material and/or a reflective layer.

While the disclosed embodiments has been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCES

100 luminous device
101 bulb
102 luminous unit
103 tip
104 bearing edge
105 bulb space
106 surface structure
107 through-bore
108 outer side
109 optical element
110 lateral surface
111 annular elevation
112 longitudinal hole
113 inner side
114 light-emitting diode
115 heat sink
116 cap
117 cooling fin
200 luminous device
201 bulb
202 light-emitting diode
203 base region
204 lateral surface
205 annular elevation
206 inner side
207 bearing surface
208 recess
209 cover region
210 bottom
211 funnel-shaped projection
212 annular projection
213 bulb space
214 driver unit
300 luminous device
301 bulb
303 base region
304 lateral surface
305 annular elevation
306 cover region
307 bore
308 bulb space
309 inner side
310 adhesive
400 luminous device
401 bulb
L longitudinal axis

The invention claimed is:

1. A semiconductor luminous device, comprising
at least one semiconductor light source and
an optically transmissive bulb for transmitting light emitted by the at least one semiconductor light source,
wherein the bulb is three-dimensionally extended and comprises
a plurality of optically effective surface structures, wherein each of the optically effective surface structures comprises an optical element and a corresponding through-bore through the bulb, wherein each optical element is configured to be insertable into the corresponding through-bore from an outer side of the bulb and to extend laterally beyond the bulb.

2. The semiconductor luminous device as claimed in claim 1, wherein each optical element comprises a hollow cylindrical base.

3. The semiconductor luminous device as claimed in claim 2, wherein each optical element further comprises at least two annular elevations.

4. The semiconductor luminous device as claimed in claim 1, wherein the bulb comprises a backward bearing edge.

5. The semiconductor luminous device as claimed in claim 4, further comprising a heat sink, wherein the bulb is fitted onto the heat sink by means of the bearing edge.

6. The semiconductor luminous device as claimed in claim 1, wherein the bulb comprises at least one recess, for receiving at least one light source, on a bearing surface.

7. The semiconductor luminous device as claimed in claim 1, wherein the optically effective surface structures are arranged in the bulb on a region of a largest lateral extent.

8. The semiconductor luminous device as claimed in claim 1, wherein at least one of the semiconductor light sources is configured to emit light in a lateral direction.

9. The semiconductor luminous device as claimed in claim 1, wherein at least one of the semiconductor light sources is configured to have its main emission direction directed towards one of the optical elements.

10. A semiconductor luminous device, comprising at least one semiconductor light source and an optically transmissive bulb for transmitting light emitted by the at least one a semiconductor light source, wherein the bulb is three-dimensionally extended and comprises a plurality of optically effective surface structures, wherein the plurality of optically effective surface structures comprises a plurality of through-bores through the bulb and a plurality of optical elements, wherein each optical element comprises a hollow cylindrical base and two annular elevations on the outer lateral surface of the cylindrical base wherein each optical element is inserted into a through-bore of the plurality of through-bores from an outer side of the bulb and extends laterally beyond the bulb, wherein the plurality of optical elements is configured to direct light emitted by the at least one semiconductor light source into a rearward direction.

* * * * *